US006558861B2

(12) United States Patent
Ito et al.

(10) Patent No.: US 6,558,861 B2
(45) Date of Patent: May 6, 2003

(54) TRANSFER SHEET AND IMAGE-FORMING METHOD

(75) Inventors: Nobuyuki Ito, Shizuoka-ken (JP); Masataka Kawahara, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/772,032

(22) Filed: Jan. 30, 2001

(65) Prior Publication Data

US 2001/0031408 A1 Oct. 18, 2001

(30) Foreign Application Priority Data

Jan. 31, 2000 (JP) ..... 2000-021086

(51) Int. Cl.[7] ..... G03G 13/01
(52) U.S. Cl. ..... 430/47
(58) Field of Search ..... 430/47

(56) References Cited

U.S. PATENT DOCUMENTS

| | | | |
|---|---|---|---|
| 4,199,356 A | 4/1980 | Matsumoto et al. | 430/126 |
| 5,366,837 A | 11/1994 | Sakai | 430/97 |
| 5,849,447 A | 12/1998 | Matsuda | 430/97 |

FOREIGN PATENT DOCUMENTS

| | | |
|---|---|---|
| EP | 0 490 293 A1 | 6/1992 |
| EP | 0 621 510 A1 | 10/1994 |
| JP | 41-20152 | 11/1941 |
| JP | 43-4151 | 2/1943 |
| JP | 49-126334 | 12/1974 |
| JP | 50-117435 | 9/1975 |
| JP | 56-16143 | 2/1981 |
| JP | 5-53363 | 3/1993 |
| JP | 9-170190 | 6/1997 |

*Primary Examiner*—Mark A. Chapman
(74) *Attorney, Agent, or Firm*—Fitzpatrick, Cella, Harper & Scinto

(57) ABSTRACT

A transfer sheet has a base layer and a specific surface layer. In a plot graph with load P (mN) as ordinate and the square of indentation depth A ($\mu$m) as abscissa, plotted when the tip of a diamond triangular pyramid penetrator having a dihedral angle of 80° is pressed in on the side of the surface layer, the plot graph has a first flexing point that appears first, a first region extending from the first flexing point to zero and a second-and-further region subsequent to the first flexing point, and a gradient H of the graph in the first region is 0.09 mN/$\mu$m$^2$ or smaller. Also disclosed are image-forming methods making use of such a transfer sheet. The transfer sheet has a superior effect of keeping dot toner images from scattering at the time of transfer. The base layer is paper made from pulp.

32 Claims, 7 Drawing Sheets

TRANSFER SHEET AND IMAGE-FORMING METHOD

BACKGROUND OF THE INVENTION

1. Field of the Invention

This invention relates to a transfer sheet. More particularly, it relates to a transfer sheet which is a transfer material to which, in electrophotographic apparatus or electrostatic printers, a toner image obtained by forming an electrostatic latent image on an image-bearing member such as a photosensitive member and developing the electrostatic latent image is transferred, and an image-forming method making use of such a transfer sheet.

2. Related Background Art

In electrophotographic apparatus, after an electrostatic latent image has been formed on a photosensitive member, the toner of a developer is made to adhere electrostatically to the electrostatic latent image to form a toner image, and this toner image is transferred to a transfer sheet (paper) by means of a transfer assembly. As transfer assemblies of this type, electrostatic transfer means such as corona transfer means and roller transfer means are known in the art.

The progress of electrophotography has taken place in copying machines. With the spread of its application to output machinery, such as page printers and facsimile machines, it has made an advance from analog systems to digital systems and is increasingly demanded to achieve higher function, more coloration and higher image quality.

Nowadays, in most electrophotographic apparatuses, the toner image held on the photosensitive member is transferred to plain paper by an electrostatic transfer means as mentioned above, where images may greatly deteriorate at the time of transfer. This deterioration causes inferior images formed by printing and ink-jet recording.

Recently, in the field of ink-jet recording other than electrophotography, it was really shocking that replacement of sheets with special exclusive sheets has brought about a dramatic improvement in image quality.

In respect of sheets of transfer sheets for electrophotography, too, a variety of proposals have been made in order to improve transfer performance and image quality. In particular, properties having energetically been studied include electrical properties, such as volume resistivity and surface resistivity of sheets. For example, in Japanese Patent Publications No. 41-20152 and No. 43-4151, it has been proposed to maintain volume resistivity within a stated range; in Japanese Patent Application Laid-Open No. 50-117435, it has been taught to provide a resin layer having a volume resistivity of $3\times10^{13}$ Ω·cm or above on the surface of transfer paper; and it has been taught in Japanese Patent Application Laid-open No. 56-16143, to provide on a transfer paper's base layer firstly a low-resistance layer and then at the outermost surface a high-resistance layer to make up a transfer sheet. In an actual service environment, however, it has been so difficult to control moisture in the air and that it has been unable to stabilize electrical resistance of transfer sheets. Accordingly, as disclosed in Japanese Patent Application Laid-open No. 5-53363, it is proposed to incorporate in a sheet a synthetic hectorite having a specific crystal structure, attempting to make a resistance value environmentally stable. Even this proposal, however, cannot provide images on the level comparable to the level of those formed by ink-jet recording or by printing.

As an approach from a different aspect, there has been a method in which an elastomer is coated on the surface of transfer paper, as disclosed in Japanese Patent Application Laid-open No. 49-126334. In an attempt to make image evaluation on a color electrophotographic apparatus by actually coating on transfer paper the material disclosed therein, no remarkable effect was observable with regard to the reproduction of a photographic image on a 400 dpi digital printer.

As the cause of image deterioration in the transfer process as stated above, it can be concluded that, a dithered pattern formed as a result of image processing employed by recent printers or a toner image formed of continuous minute individual dots by PWM (pulse width modulation) stands scattered when digital data are outputted. This tends more remarkably in the case of, e.g., very fine dots of a screen on which small characters or image data are formed. A one-dot toner image that constitutes binary image data of 400 dpi has a size of about 64 μm. As for the improvement in dot reproducibility of about such size, it cannot be expected at all by any conventional means stated above, showing capability not different at all from ordinary transfer sheets. More specifically, in conventional means, ink-jet recording enables reproduction of 800 dpi photographic images, whereas electrophotographic processing has been unsatisfactory in any effort to reproduce true 400 dpi photographic images, because of the image deterioration (a decrease in gradation) caused in the transfer process.

However, even though the means disclosed in the above Japanese Patent Application Laid-open No. 49-126334 is old, the inventors have been interested in that its means relies on a mechanical phenomenon which may hardly be affected by environmental factors, different from other resistance values or the like. However, has been found that, even for soft elastomers used at present in, e.g., intermediate transfer members of the latest color copying machines, it is difficult to transfer binary images (toner images) of 400 dpi without scattering.

Japanese Patent Application Laid-open No. 9-170190 discloses a transfer sheet made to have a fibrous surface as a recording sheet for output machinery of various types. This publication discloses that its fibers exhibit a cushioning performance and hence can make dry-process electrophotographic toner images sharp. However, as also shown in its Examples, the thickness of the fiber used, though fairly as small as 0.5 denier, is only on the level of the particle size of electrophotographic toners. Hence, the cushioning performance exhibited by fibers which mutually slide as so described in the above publication may be expectable for making large-size characters or the like sharp at best, but is not so expectable as to absorb kinetic energy of individual toner particles as aimed in the present invention. Materials disclosed as examples in the above publication are celluloses and polyester resins, which are materials of the same nature as, or harder than, those of toners, and hence, as the materials alone, they are not expectable at all for any cushioning performance on individual toner particles.

SUMMARY OF THE INVENTION

An object of the present invention is to provide a transfer sheet having solved the above-noted problems, and an image-forming method making use of the transfer sheet.

More specifically, an object of the present invention is to provide an electrophotographic transfer sheet which has a superior effect of keeping dot toner images from scattering at the time of transfer, and an image-forming method making use of the transfer sheet.

To achieve the above-noted object, the present invention provides a transfer sheet comprising a base layer and a surface layer formed on at least one surface of the base layer, wherein;

in a plot graph with load P (mN) as ordinate and the square of indentation depth A ($\mu$m) as abscissa, plotted when the tip of a diamond triangular pyramid penetrator having a dihedral angle of 80° is pressed in on the side of the surface layer;

the plot graph has a first flexing point that appears first, a first region extending from the first flexing point to zero and a second-and-further region subsequent to the first flexing point; and a gradient H of the graph in the first region is 0.09 mN/$\mu$m$^2$ or smaller; and the base layer includes paper made from pulp.

The present invention also provides an image-forming method comprising;

a toner image forming step of forming a toner image by means of a toner; and a transfer step of transferring the toner image formed, to a transfer sheet;

wherein;

the transfer sheet has a base layer and a surface layer formed on at least one surface of the base layer; and in a plot graph with load P (mN) as ordinate and the square of indentation depth A ($\mu$m) as abscissa, plotted when the tip of a diamond triangular pyramid penetrator having a dihedral angle of 80° is pressed in on the side of the surface layer;

the plot graph has a first flexing point that appears first, a first region extending from the first flexing point to zero and a second-and-further region subsequent to the first flexing point; and a gradient H of the graph in the first region is 0.09 mN/$\mu$m$^2$ or smaller. and the base layer includes paper made from pulp.

DESCRIPTION OF THE PREFERRED EMBODIMENTS

Figure 1:
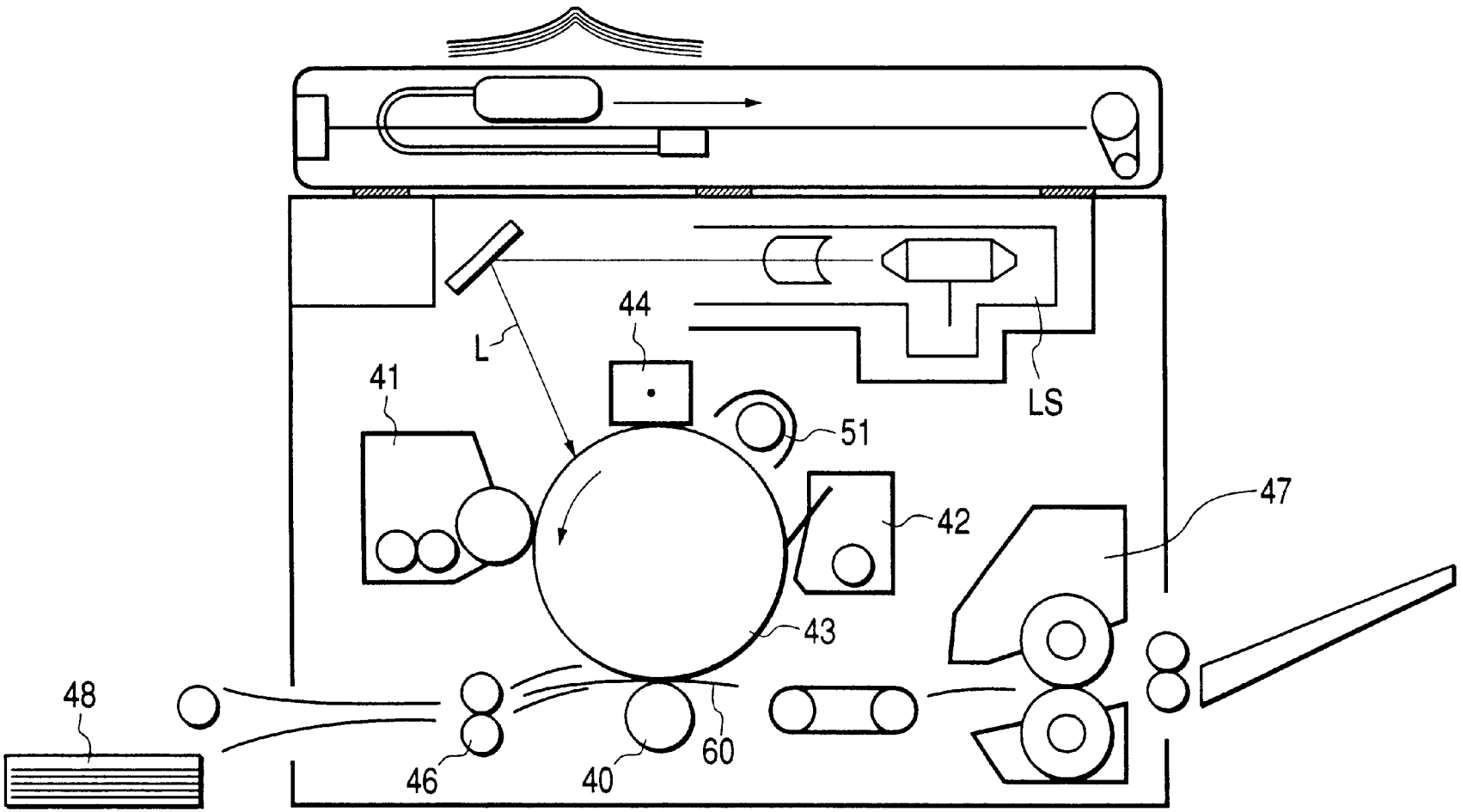
FIG. 1 is a cross-sectional view of a printer according to an embodiment of an image-forming apparatus in which the present invention is applied.

The present invention will be described below in detail by discussing preferred embodiments of the present invention.

The present inventors made extensive studies in order to more improve the mechanical cushioning performance of transfer sheets to toners. As the result, they have discovered that, in the case of binary images of 600 dpi, the performance can be improved so far as no scattering occurs at all on dot toner images at the time of transfer where an ethylene-propylene copolymer resin, which has never been studied in view of cost and solubility, is coated on the surface of a transfer sheet.

To investigate the reason therefor, a thin-film physical properties evaluation apparatus MH4000, manufactured by NEC, was used to examine the relationship between depth and load of the indentation to a transfer sheet, of a diamond triangular pyramid penetrator having a dihedral angle of 80°. As the result, it has been elucidated that, the load necessary for indenting the penetrator by 1 $\mu$m is 0.25 mN in the case of ordinary transfer paper, whereas a value of 0.01 mN or smaller is shown which is smaller by one figure or more, in the case of a transfer surface formed by coating on the surface of a transfer sheet the ethylene-propylene copolymer resin having the effect of keeping dot toner image from scattering at the time of transfer.

The surface of a transfer paper as a transfer sheet having such characteristic features can be sufficiently soft even against individual toner particles having a slight weight, and hence the effect of keeping toner images from losing their shape or scattering can be attained because the surface can embrace individual toner particles or the toner is not flipped onto the transfer sheet surface, as so presumed.

The transfer sheet of the present invention which can have such an effect is required to have a base layer and a surface layer in which, in a plot graph with load P (mN) as ordinate and the square of indentation depth A ($\mu$m) as abscissa, plotted when the tip of a diamond triangular pyramid penetrator having a dihedral angle of 80° is pressed in on the side of the surface layer, the graph has, in a first region extending to zero from a first flexing point that appears first, a gradient H of 0.09 mN/$\mu$m$^2$ or smaller.

The gradient H of the graph in the first region may be smaller than any gradient of the graph in its second-and-further region. This is preferable because the transfer sheet can have proper mechanical strength.

The gradient of the graph in its second-and-further region is defined, in the case when the graph has a second flexing point, to be a gradient of the graph extending from the first flexing point to the second flexing point; and, in the case when the graph has no second flexing point, to be an average value of the gradient of the graph at its points subsequent to the first flexing point because the base layer is uniform and hence the gradient of the graph in the second-and-further region extends basically in a straight line.

The gradient H according to the present invention can be materialized with ease by providing as the surface layer a desired resin or elastomer coating layer on the transfer surface of the transfer sheet. The constitution, operation and effect of the present invention and also preferred embodiments thereof will be described in detail in the following Examples.

The transfer sheet of the present invention is basically comprised of a base layer and a surface layer formed on at least one surface of the base layer.

The base layer comprises, for example, paper made from pulp, metal foil such as aluminum foil, or resin sheet such as polyethyleneterephthalate sheet. In the present invention, it is particularly effective to use paper which hardly provides sheet stiffness itself.

As the surface layer, a resin or an elastomer may be used.

EXAMPLE 1

FIG. 1 is a schematic illustration of an image-forming apparatus in which the transfer sheet of the present invention is applied. As an image-bearing member, for example a photosensitive drum 43 (photosensitive member) is rotated in the direction of an arrow at a process speed of 100 mm/s. This photosensitive drum 43 is formed of a photoconductive material of organic photosensitive member types. The apparatus is an electrophotographic recoding apparatus having the photosensitive drum 43 and provided around it a charging assembly 44, an exposure assembly LS, a developing assembly 41, a transfer charging assembly 40 and a cleaning unit 42.

A charging means used in primary charging may include a noncontact charging system making use of a corona charging assembly, and a contact charging system making use of a roller charging assembly.

Conditions for the charging and exposure of the photosensitive member are those under which the photosensitive drum is charged to, e.g., a negative polarity to provide charge potential and is exposed to light by an exposure means to attenuate the potential at exposed areas. In the present Example, a semiconductor laser optical system is used as the exposure assembly LS. The drum charge potential is set at −400 V, and exposed areas solid image areas at −50 V. As the exposure means, besides the semiconductor laser, other optical systems may be used, as exemplified by LEDs set up via a SELFOC lens, EL devices and plasma light-emitting devices.

The photosensitive drum 43 is a negatively chargeable organic photoconductor (OPC), and comprises a drum type substrate made of aluminum with a diameter of 30 mm, and provided thereon with a functional layer consisting of the following five layers, first to fifth layers in order from the substrate.

The first layer is a subbing layer, which is a conductive layer of about 20 $\mu$m thick, provided in order to level any defects of the aluminum drum and also in order to prevent Moiré from being caused by the reflection of laser exposure light.

The second layer is a positive-charge injection preventive layer, which plays a role in which positive charges injected from the aluminum substrate are prevented from cancelling negative charges produced on the photosensitive member surface by charging, and is a medium-resistance layer of about 1 $\mu$m thick whose resistance has been controlled to about $10^6$ Ω·cm by Amilan resin (6-nylon) and methoxymethylated nylon.

The third layer is a charge generation layer, which is a layer of about 0.3 $\mu$m thick, formed of a resin having a bisazo pigment dispersed therein, and generates positive or negative electron pairs upon laser exposure.

The fourth layer is a charge transport layer, which is formed of a polycarbonate resin having a triphenylamine type charge-transporting material dispersed therein, and is a p-type semiconductor. Hence, the negative charges produced on the photosensitive member surface by charging can not migrate through this layer and only the positive charges produced in the charge generation layer can be transported to the photosensitive member surface. As the charge transport layer, one having a layer thickness of 15 $\mu$m is used.

The fifth layer is a surface protecting layer, which is a layer of 3 $\mu$m thick, formed of a polycarbonate resin having polytetrafluoroethylene fine particles dispersed therein.

The surface protecting layer as the fifth layer may be made by using any known materials, but it does not always need to provide the surface protecting layer.

As the surface protecting layer, besides wear resistance layer in which fluorine atom-containing resin fine particles such as polytetrafluoroethylene are dispersed in the binder resin, used in the example, semiconductive layer in which conductive material is dispersed in the binder resin to impart conductivity may be formed.

The fluorine atom-containing resin fine particles may include one or two types selected from the group consisting of polytetrafluoroethylene, polychlorotrifluoroethylene, polyfluorinated vinylidene, polydichlorodifluoroethylene, tetrafluoroethylene-perfluoroalkylvinylether copolymer, tetrafluoroethylene-hexafluoropropylene copolymer, tetrafluoroethylene-ethylene copolymer and tetrafluoroethylene-hexafluoropropylene-perfluoroalkylvinylether copolymer.

The conductive material may include metallocene compound such as dimethylferrocene, and metal oxide such as antimony trioxide, tin oxide, titanium oxide, indium oxide and ITO.

The binder resin may include known resins such as polyamide, polyester, polycarbonate, polystyrene, polyacrylamide, silicone resin, melamine resin, phenol resin, epoxy resin and urethane resin.

Where laser light is scanned with a laser operation section LS, laser light (680 nm, 35 mW semiconductor laser, having an optical spot diameter of about 63 $\mu$m in both the secondary scanning direction and the main scanning direction) emitted from a laser device by means of a light-emitting signal generator in accordance with image signals inputted is first converted to substantially parallel light rays by means of a collimator lens system and is further scanned with a rotating polygonal mirror being rotated, in the course of which an image is formed in spots or dots through an fθ lens group on the scanned surface of an image-bearing member such as the photosensitive drum. As a result of such scanning of laser light, exposure distribution corresponding to one imagewise scanning is formed on the scanned surface, where the scanned surface is positionally shifted by a predetermined extent in the direction perpendicular to the scanning direction, thus exposure distribution corresponding to image signals is provided on the scanned surface.

In the present Example, multi-level recording is performed under one-pixel area gradation in a resolution of 200 dpi, using a laser PWM (pulse width modulation) system. Accordingly, the PWM system will be described briefly.

Digital image signals of 8 bits change on the level of 256 gradations of from 00 h (white) to FF (black). PWM signals with a pulse width corresponding to the density of pixels to be formed are generated. Then, the PWM signals are inputted to a laser driver circuit. In accordance with PWM signal values thus obtained, exposure time per one pixel is changed, whereby 256 gradations at maximum can be provided per pixel. In the present Example, used is gradation control by such a PWM system. Also usable are an area gradation method such as a dithering method and a laser light intensity modulation method. In addition, any of these methods may be used in combination.

In the developing assembly 41, with which the dot-distributed electrostatic latent image formed on the photosensitive drum 43 is rendered visible, held is a two-component type developer comprised of a blend of toner particles and magnetic carrier particles.

As a toner, any known toner prepared by adding a colorant and a charge control agent to a binder resin may be used. In the present Example, a toner having a volume-average particle diameter of 7 $\mu$m is used. Here, the volume-average particle diameter of the toner is measured by the following measuring method.

As a measuring device, a Coulter counter Model TA-II or Coulter Multisizer (manufactured by Coulter Electronics, Inc.) is used. An interface (manufactured by Nikkaki k.k.) that outputs number-average distribution and volume-average distribution and a personal computer CX-i (manufactured by CANON INC.) are connected. As an electrolytic solution, an aqueous 1% NaCl solution is prepared using first-grade sodium chloride.

Measurement is made by adding as a dispersant 0.1 to 5 ml of a surface active agent (preferably an alkylbenzene sulfonate) to 100 to 150 ml of the above aqueous electrolytic solution, and further adding 0.5 to 50 mg of a sample to be measured. The electrolytic solution in which the sample has been suspended is subjected to dispersion for about 1 minute to about 3 minutes in an ultrasonic dispersion machine. The volume distribution is calculated by measuring the particle size distribution of particles of 2 to 40 $\mu$m by means of the Coulter counter Model TA-II or Coulter Multisizer, using an aperture of 100 $\mu$m as its aperture. From the volume distribution thus determined, volume-average particle diameter of the sample is found.

In the case of the two-component type developer having a toner and a carrier, preferably usable as the carrier is a carrier comprised of magnetic particles provided on particle surfaces with very thin resin coatings. It may preferably have an average particle diameter of from 5 to 70 $\mu$m. Here, the average particle diameter of the carrier is defined by an average value of horizontal-direction maximum length. It may be measured by microscopy. At least 300 carrier particles are picked up at random, and their horizontal-direction maximum length is actually measured and its arithmetic mean is taken to regard the resultant value as the average particle diameter of the carrier.

As the toner, used is a toner chargeable to proper polarity for developing the electrostatic latent image, upon friction with magnetic particles.

Figure 2:
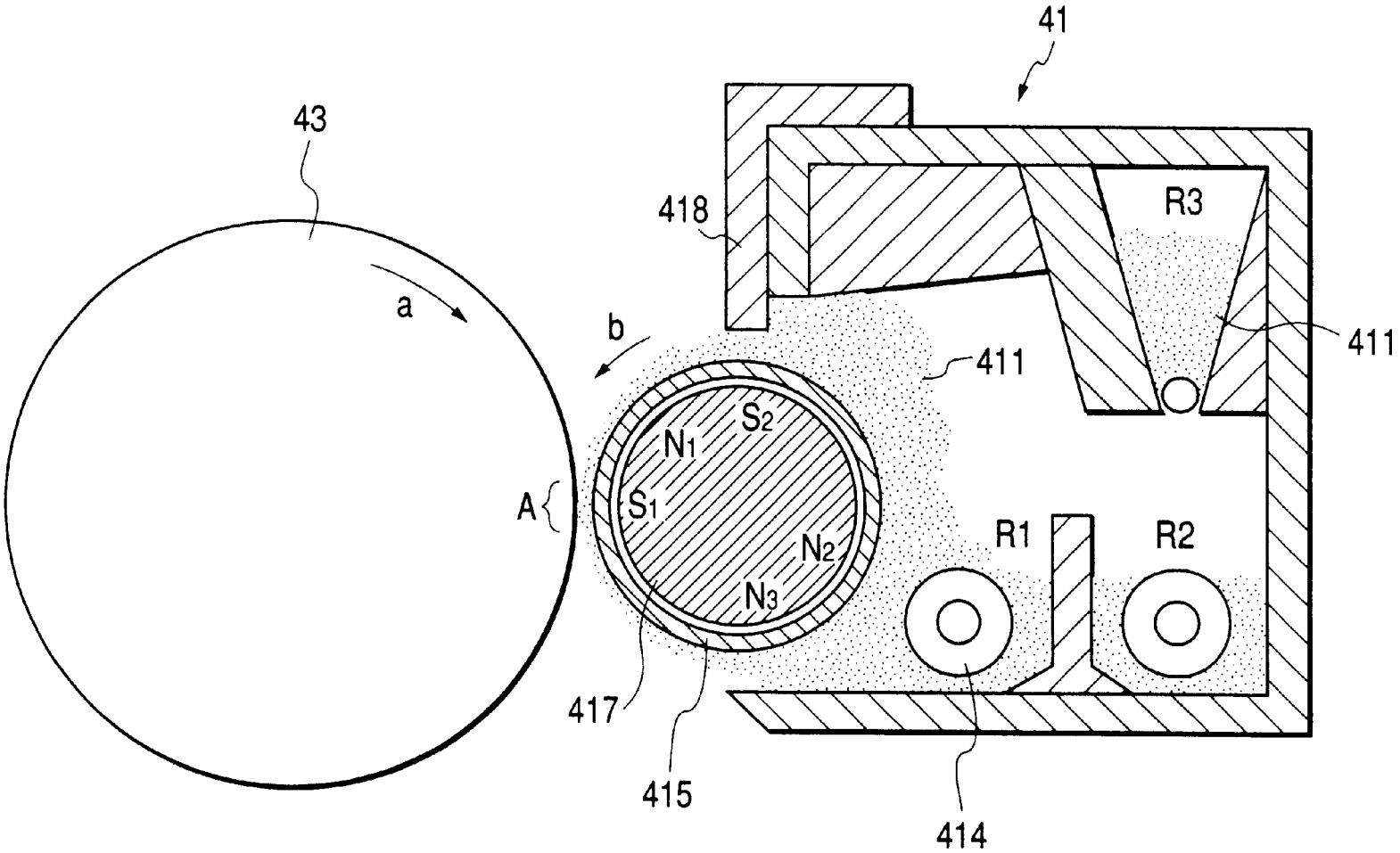
FIG. 2 is a cross-sectional view of a developing unit of the printer according to an embodiment of an image-forming apparatus in which the present invention is applied.

As shown in FIG. 2, the developing assembly 41 is provided with an opening at its part adjacent to the photosensitive drum 43. At this opening, a nonmagnetic developing sleeve 415 made of aluminum or nonmagnetic stainless steel is provided.

The developing sleeve 415 is rotated in the direction of an arrow b and carries and transports to a developing zone A a developer 411 comprised of a blend of the toner and the carrier. At the developing zone A, a magnetic brush of the developer carried on the developing sleeve 415 comes into contact with the photosensitive drum 43 being rotated in the direction of an arrow a, and the electrostatic latent image is developed at this developing zone A.

To the developing sleeve 415, an oscillatory bias voltage formed by superimposing a DC current on an AC current is applied from a power source (not shown). The dark-area potential (non-exposed-area potential) and light-area potential (exposed-area potential) formed correspondingly to the electrostatic latent image are positioned between the maximum value and minimum value of the oscillatory bias voltage. Thus, an alternating electric field which alternately changes in direction is formed at the developing zone A. In this alternating electric field, the toner and the carrier vibrate vigorously, and the toner tears itself away from the electrostatic confinement to the sleeve and carrier to come to adhere to the photosensitive drum 43 correspondingly to the electrostatic latent image.

The oscillatory bias voltage may preferably have a difference between the maximum value and the minimum value (a peak-to-peak voltage), of from 1 to 5 kV, and also a frequency of from 1 to 10 kHz. As the waveform of the oscillatory bias voltage, rectangular waveform, sine waveform or triangle waveform may be used.

The above DC voltage component, which is a component having a value intermediate between the dark-area potential and the light-area potential which correspond to the electrostatic latent image, may preferably be a value closer to the dark-area potential than the light-area potential having the minimum value as absolute value, in order to prevent a fogging toner from adhering to the dark-area potential region.

It is preferable for a minimum gap between the developer sleeve 415 and the photosensitive drum 43 (this minimum gap is positioned within the developing zone A) to be from 0.2 to 1 mm.

Reference numeral 418 denotes a developing blade serving as a developer layer thickness regulation member, and regulates the layer thickness of the two-component type developer the developer sleeve 415 carries and transports to the developing zone A. The developer regulated by the developing blade 418 and transported to the developing zone A may preferably be in such a quantity that the developer magnetic brush formed by the action of a magnetic field formed at the developing zone by a developing magnetic pole S1 described later has a height on the developer sleeve surface, of from 1.2 to 3 times the value of the minimum gap between the developer sleeve and the photosensitive drum in the state the photosensitive drum 43 has been removed.

Inside the developer sleeve 415, a roller type magnet 417 is disposed stationarily. This magnet 417 has the developing magnetic pole S1 opposing the developing zone A. The magnetic brush of the developer is formed by the action of a developing magnetic field the developing magnetic pole S1 forms at the developing zone A. This magnetic brush comes into contact with the photosensitive drum 43 to develop the dot-distributed electrostatic latent image.

The developing magnetic field formed by the developing magnetic pole S1 may preferably have a strength on the developer sleeve 415 surface (magnetic flux density in the direction perpendicular to the sleeve surface), of from 500 to 2,000 gauss as its peak value. In the present Example, the magnet 417 has, besides the developing magnetic pole S1, poles N1, N2, N3 and S2, five poles in total. With such constitution, the developer drawn up with the pole N2 as the developer sleeve 415 is rotated is transported from the part of pole S2 to the part of pole N1, on the way of which the developer is regulated by the developer layer thickness regulation member 418 to form a developer thin layer. Then, the developer, having risen in ears in the magnetic field formed by the developing magnetic pole S1 develops the electrostatic latent image held on the image-bearing member 43. Thereafter, a repulsion magnetic field between the pole N3 and the pole N2 makes the developer on the developer sleeve 415 fall into an agitator chamber R1. The developer fallen into the agitator chamber R1 is agitated and transported by a screw 414.

In this way, the electrostatic latent image formed on the photosensitive drum 43 is reverse-developed by means of the developing assembly 41, and the toner image thus formed is led to a pressure contact nip (transfer zone) at a given timing; the nip formed between the photosensitive drum 43 and a transfer roller 40 serving as a contact transfer means brought into contact with the drum surface at a stated pressure via a transfer sheet 60 fed as a recording sheet from a paper feed section 48. To the transfer roller 40, a stated transfer bias voltage is applied from a transfer bias applying power source (not shown). In the present Example, a roller having a roller resistivity of $5\times10^8$ Ω·cm is used and a DC voltage of 5 kV (the transfer bias voltage may properly be adjusted depending on the type of transfer sheet and on environment) is applied to perform transfer. The transfer sheet 60 led to the transfer zone is interposingly held and transported through this transfer zone, where the toner image formed and held on the surface of the photosensitive drum 43 is successively transferred to the transfer sheet on its surface side by the action of electrostatic force and pressing force. The transfer sheet 60 to which the toner image has been transferred is separated from the surface of the photosensitive drum 43 by means of a separation charging assembly (not shown) and then guided into a heat-fixing type fixing assembly 47, where the toner image is fixed, and the resultant sheet is delivered outside the apparatus as an image-formed material (a print or a copy). Meanwhile, the surface of the photosensitive drum 43 from which the toner image has been transferred is cleaned by means of a cleaner 42 to remove any deposit contaminant such as transfer residual toner, and is repeatedly used for image formation.

The coating material used to produce the transfer sheet used in the present Example was prepared in the following way.

2 parts by weight of a resin having repeating units represented by the following Formulas (1) and (2) [containing 40 mole % of the component represented by the following Formula (2)] was dissolved in 78 parts by weight of n-hexane. Then, the resultant solution was put to a centrifugal separator to remove gel components, thus a coating material was prepared. This coating material was coated on art paper by means of a Meyer bar (#16), followed by drying at 120° C. for 1 hour and further followed by drying at 140° C. for 1 hour to produce the transfer sheet used in the present Example. After the drying, the surface layer resin coating layer was in a thickness of 2 μm.

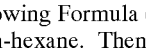

(1)

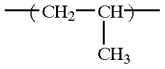

(2)

Figure 7:
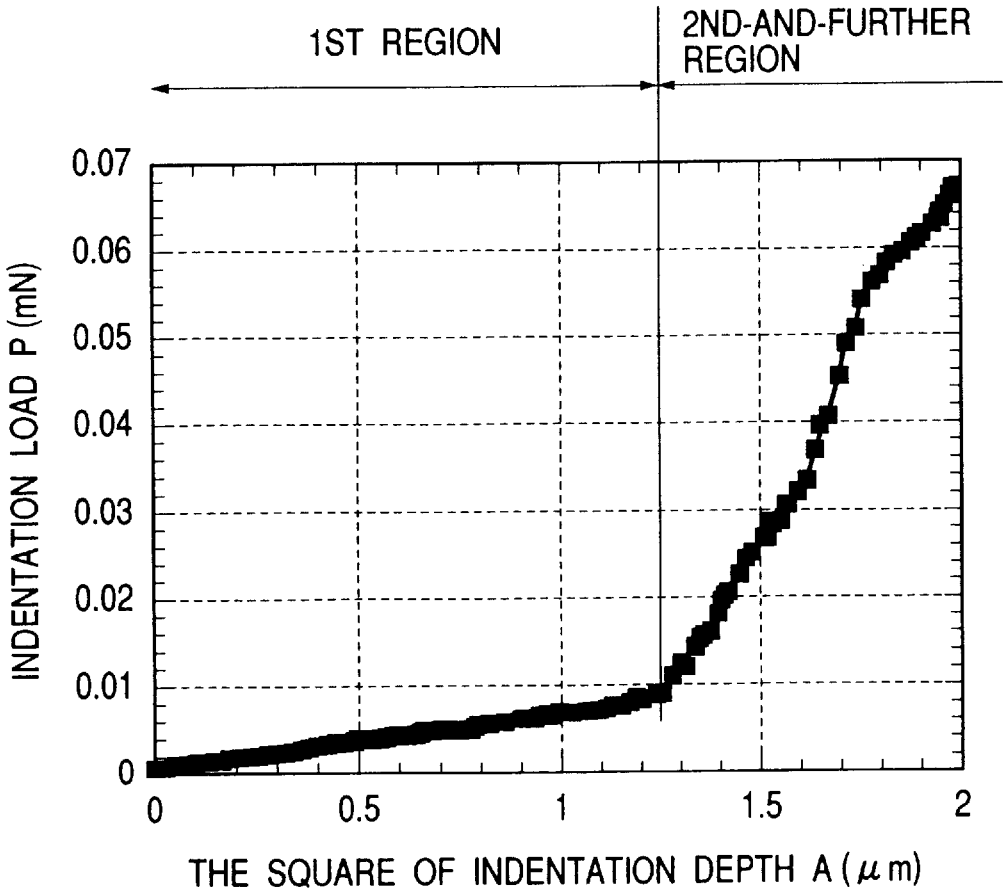
FIG. 7 is a graph showing changes in the square of indentation depth A with respect to load P in Embodiment 1 according to the present invention.

Using MH4000, manufactured by NEC, the tip of a diamond triangular pyramid penetrator having a dihedral angle of 80° was pressed in the transfer surface layer of the above transfer sheet at an indentation rate of 21 nm/s to draw a plot graph with load P (mN) as ordinate and the square of indentation depth A (μm) as abscissa, as shown in FIG. 7.

As can be seen therefrom, the plot graph has a first flexing point that appears first, a first region extending from the first flexing point to zero and a second-and-further region subsequent to the first flexing point. As measurement results, the hardness of only the surface layer material can be represented as a gradient of the graph in the linear first region that is proportional to the load P and the square of indentation depth A (flexing points for the layer lying beneath the surface layer appear in the second-and-further region). More specifically, the gradient H of the graph in the first region is found from FIG. 7 to be 0.0065 mN/$\mu m^2$, and an average of the gradient of the graph in the second-and-further region subsequent to the first flexing point is found to be 0.0734 mN/$\mu m^2$.

On the other hand, as measurement results obtained similarly on a conventional art paper, a transfer sheet not coated with the material having repeating units represented by the above Formulas (1) and (2), there appeared substantially no first flexing point, and the gradient H of the plot graph was found to be 0.25 mN/$\mu m^2$.

Figure 3:
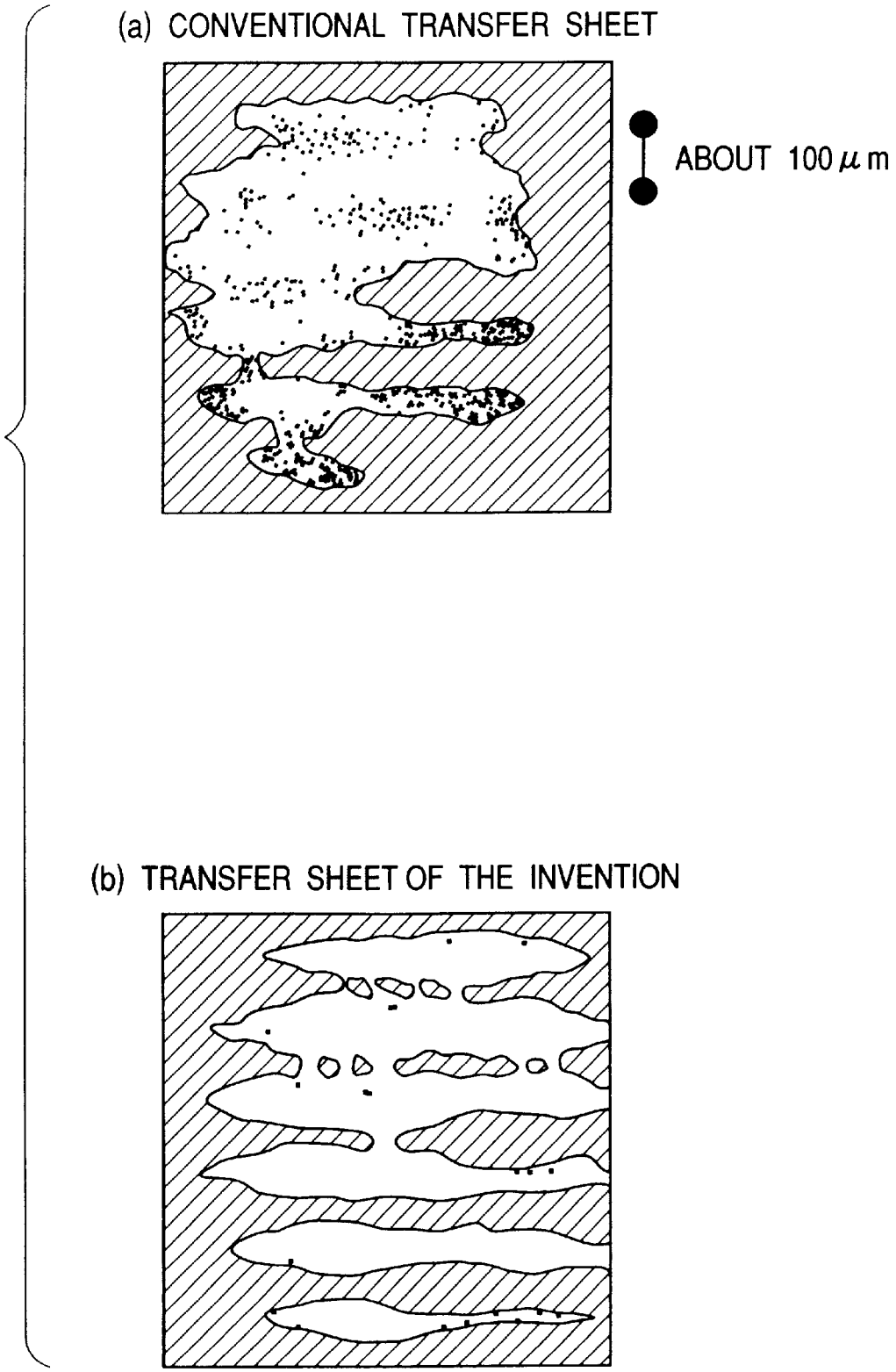
FIG. 3 illustrates the results of image reproduction in Embodiment 1 according to the present invention.
Figure 4:
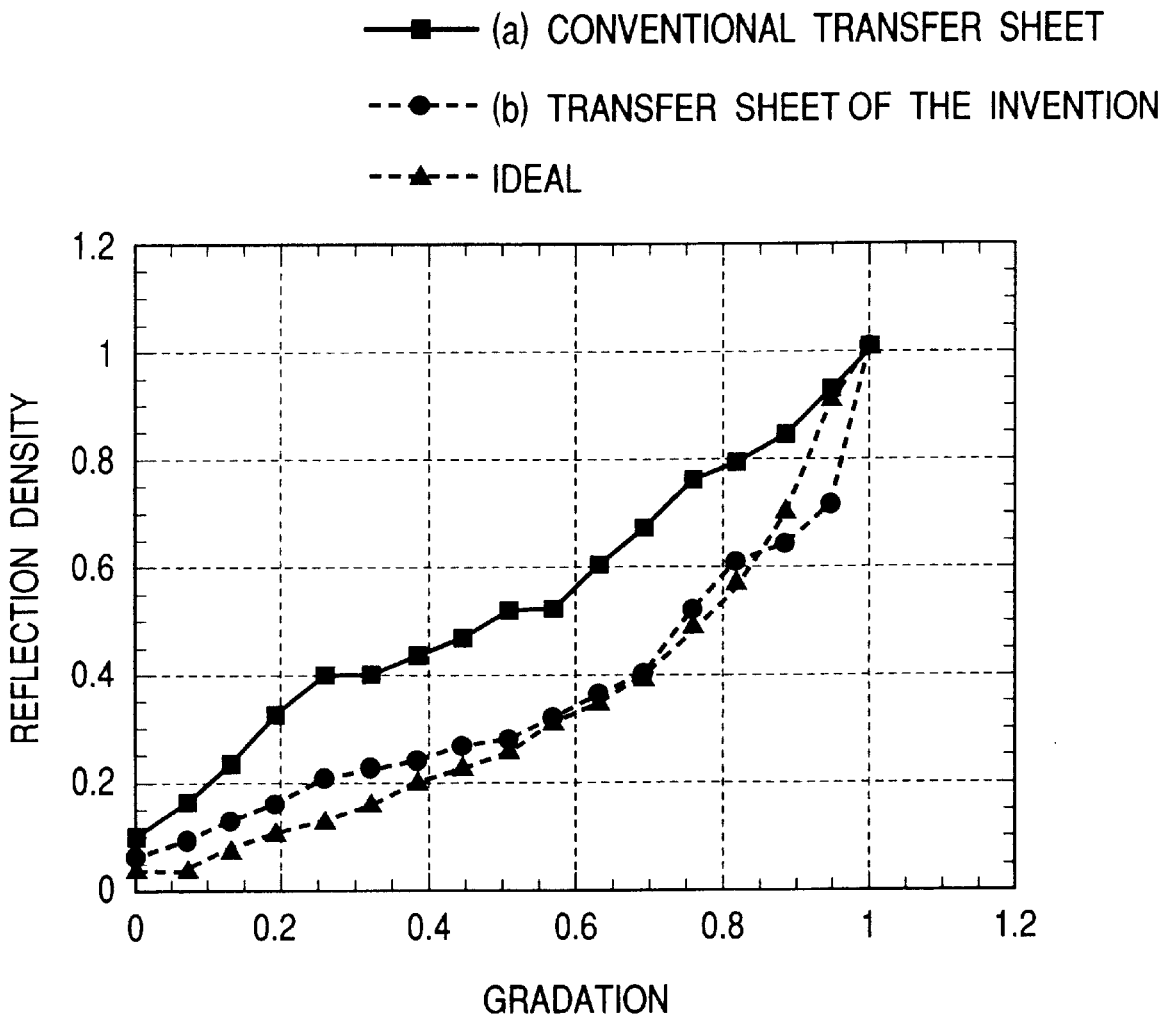
FIG. 4 is a graph showing changes in reflection density with respect to area gradation in Embodiment 1 according to the present invention.

The results of image reproduction carried out using the above-described coated paper under the conditions described above are compared on (a) and (b) in FIG. 3. Shown as (a) and (b) in FIG. 3 are diagrammatic illustrations based on enlarged actual photographs of image reproduction made on transfer sheets under the same conditions but changing the transfer sheet. Shown as (a) in FIG. 3 is the case of the conventional transfer sheet; and (b) in FIG. 3, the case of the transfer sheet of the present invention, coated in the manner described above. In comparison of theses results, the transfer sheet (b) in FIG. 3 of the present invention is found to enable good image reproduction without causing any transfer scattering, which is so good that the time for which the laser is put on in accordance with the PWM signals may clearly be seen. It was found that, as a result of such image reproduction performable in this way, changes in reflection density with respect to area gradation were, as shown in FIG. 4, substantially in agreement with an ideal line only on account of the use of the transfer sheet of the present invention. On the other hand, in the conventional transfer sheet, optical dot gain at highlighted areas increased greatly as shown as (a) in FIG. 3, resulting in a reduction of dynamic ranges of change in reproduced-image density. More specifically, the use of the transfer sheet of the present invention has made it possible to reproduce, from electrophotographic apparatus, images having a high resolution and high gradation comparable to that of silver salt photographs.

EXAMPLE 2

Figure 5:
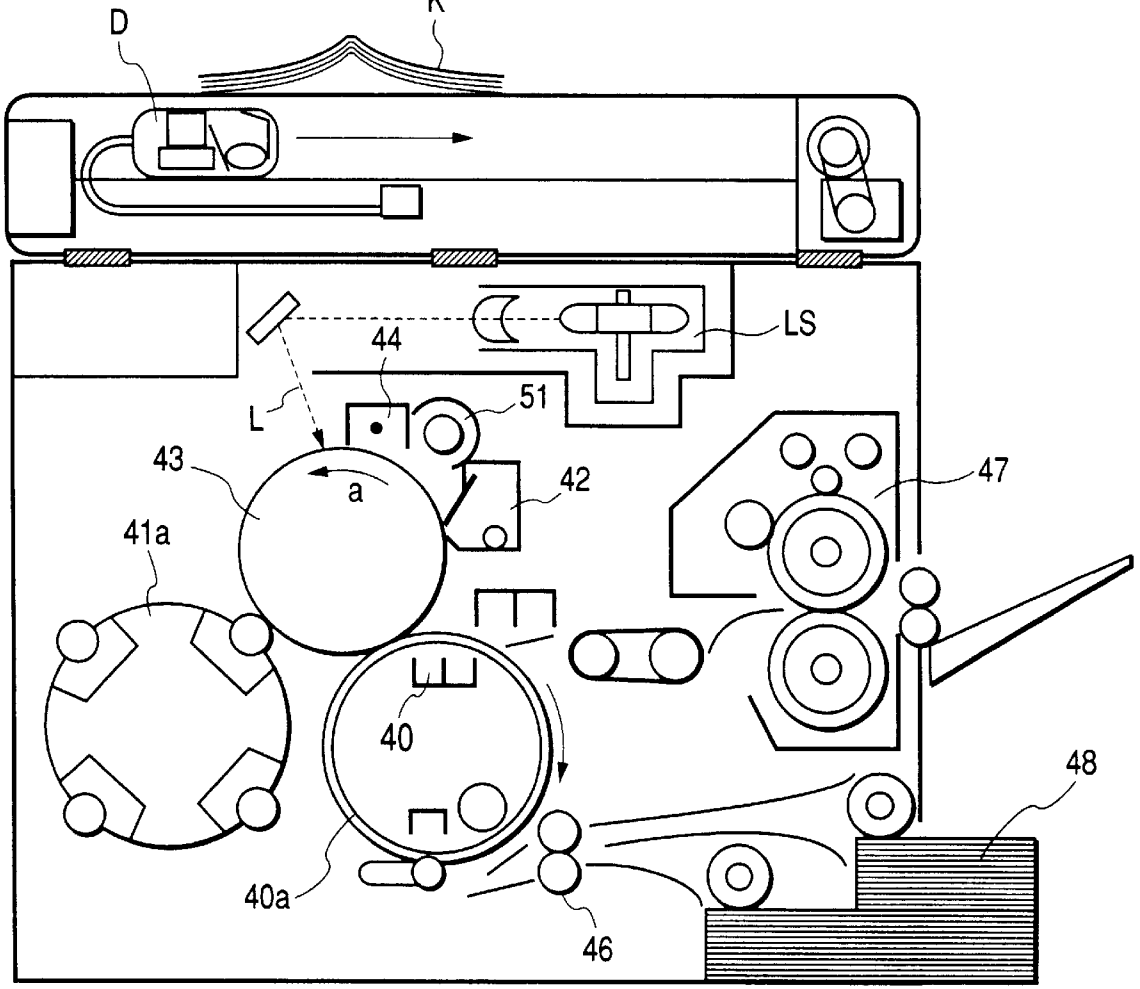
FIG. 5 is a cross-sectional view of a printer according to another embodiment of an image-forming apparatus in which the present invention is applied.
Figure 6:
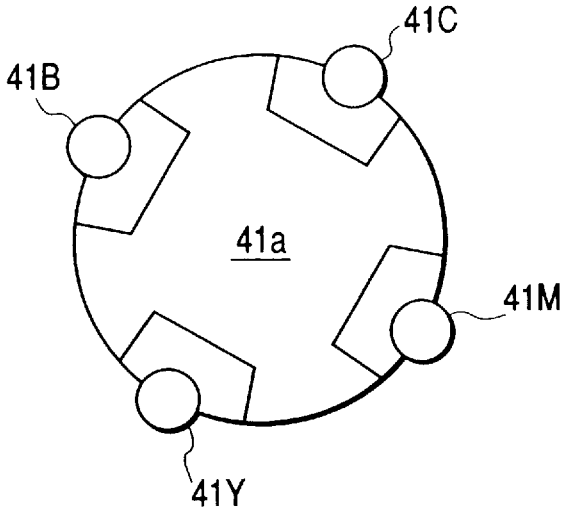
FIG. 6 illustrates a rotary developing unit shown in FIG. 5.

FIG. 5 cross-sectionally illustrates a copying machine which can form full-color images. In FIG. 5, reference numeral 43 denotes a photosensitive drum having the same formulation as in Example 1, rotated in the direction of an arrow. Around the photosensitive drum 43, a primary charging assembly 44, a rotary developing unit 41*a*, a transfer assembly 40 and a cleaning assembly 42 are provided. On the paper feed side of the transfer assembly 40, a paper feed cassette 48, registration rollers 46 and so forth are provided. On the paper output side, separation claws (not shown), a transport section (not shown), a fixing assembly 47, a paper output tray (not shown) and so forth are provided. The rotary developing unit 41*a* is, within a rotating support member rotatable around a shaft, provided with four developing assemblies, i.e., a cyan developing assembly 41C, a magenta developing assembly 41M, a yellow developing assembly 41Y and a black developing assembly 41B (see FIG. 6) having a cyan toner, a magenta toner, a yellow toner and a black toner, respectively, and is so constructed that any given developing assembly can be positioned on the side zone of the photosensitive drum 43.

The transfer assembly 40 is an assembly on which the transfer sheet is held at fixed position along the periphery of a transfer drum 40*a* via a gripper (not shown) and, as the transfer drum 41*a* is rotated, the toner image held on the photosensitive drum 43 is transferred onto a transfer sheet adjoining to one side of the photosensitive drum 43.

A copying original K is read with an original reader D. This reader has a photoelectric transducer such as CCD (charge-coupled device) that converts an original image into electrical signals, and outputs image signals corresponding respectively to magenta image information, cyan image information, yellow image information and black-and-white image information of the original K. A semiconductor laser built in a scanner LS is controlled correspondingly to image signals and emits a laser beam L. In the present Example, too, gradation control by the PWM system described previously is employed. Incidentally, output signals from a computer can also be printed out.

With such construction, the surface of the photosensitive drum 43 charged uniformly by means of the primary charging assembly 44 is exposed to image light L emitted in accordance with, e.g., the magenta image information through an image-reading exposure section, whereupon an electrostatic latent image is formed on the photosensitive drum 43. The electrostatic latent image is, as the photosensitive drum 43 is rotated, forwarded to the magenta developing assembly 41M previously positionally set, of the rotary developing unit 41*a*, where the magenta toner is supplied from the magenta developing assembly 41M and the electrostatic latent image is rendered visible as a toner image. The toner image is transferred onto the transfer sheet held on the transfer drum 40*a*.

Then, the photosensitive drum 43 from which the toner image has been transferred is cleaned by means of the cleaning assembly 42 to remove any toner remaining thereon. Thereafter, it is again charged uniformly by means of the primary charging assembly 44, and then exposed to image light L emitted in accordance with the cyan image information through the image-reading exposure section, whereupon an electrostatic latent image is formed on the photosensitive drum 43. Then, the electrostatic latent image is, upon supply of the cyan toner from the cyan developing assembly 41C, rendered visible as a toner image. The toner image is superimposingly transferred onto the transfer sheet held on the transfer drum 40*a* and to which the magenta toner image has been transferred. Toner images developed by means of the yellow developing assembly 41Y and the black developing assembly 41B in accordance with the yellow image information and the black image information, respectively, are likewise superimposingly transferred onto the transfer sheet (a multi-transfer system). In the case when the gradation control by the PWM system is used, it provides a transfer process in which multiple colors are superimposed at the same position.

Transfer sheets kept in the paper feed cassette 48 are sheet-by-sheet taken up with paper feed rollers. Each transfer sheet is thereafter sent toward the registration rollers 46, and is sent toward the transfer assembly 40 through the registration rollers 46 at a controlled timing. The transfer sheet to which the above four color toner images transferred superimposingly as the transfer drum 40*a* of the transfer assembly 40 is rotated is separated from the transfer drum 40*a* via the separation claws (not shown) and then sent toward the fixing assembly 47 via the transport section (not shown). Then, by means of this fixing assembly 47, the multi-color superimposed toner images are melted and color-mixed to develop colors and fixed to form a full-color image finally. The transfer sheet having passed through the fixing is laid on the paper output tray (not shown), thus a series of operations for image formation is completed.

The transfer sheet used here is coated paper formulated in the same manner as in Example 1.

In the multiple transfer process as described above in which dot toner images having been finely area gradation controlled by the PWM system of the present Example are superimposed in four colors at the same position and in the desired proportion, for example the third-color toner image is transferred onto places to which the first- and second-color toner images have been transferred, where an impact given at the time of third-color transfer comes to as far as the transfer sheet surface through first- and second-color toner layers and the impact is absorbed there, or a soft transfer sheet surface embraces the whole first- to third-color toner layers to bring about the intended effect, as so presumed.

EXAMPLE 3

10 kinds of transfer sheets were produced in the same manner as in Example 1 except that solution concentration and coating rod size were so changed as to form the coating layers of 0.5 μm, 1 μm, 5 μm, 10 μm, 20 μm, 50 μm, 100 μm, 200 μm, 300 μm and 500 μm thick.

A machine used for image reproduction is the same digital monochromatic copying machines as that used in Example 1. A computer is connected to it so that binary error-diffused image data of 600 dpi can be sent to the copying machine and outputted therefrom. This enables simple examination on however output results are faithful to the data. As the result, the effect attributable to the present invention was confirmed where the thickness of coating layers was 0.5 μm and up to 100 μm, and the effect attributable to the present invention was remarkably confirmed where the thickness of coating layers was 1 μm and up to 100 μm.

As a tendency, when the coating layer is 0.5 μm thick, a difference in the effect of the present invention is so small as to be little seen, compared with the case when it is 1 μm thick, but toner scatters slightly and the dot toner image comes to have a rounder contour with an increase in the thickness of the coating layer on the transfer sheet base layer (rather, it even looked better than that on the photosensitive member before transfer). However, a phenomenon of becoming less effective comes to be seen about those of 200 μm thick or larger in a region of dot toner image dense, and the same phenomenon as that is seen on those of 500 μm thick or larger even in the case of isolated-dot toner images. To investigate the reason therefor, the thickness of a transfer sheet base layer used in the 100 μm thick coating was made smaller to examine the faithfulness of dot toner images after transfer to such transfer sheets. As a consequence, the phenomenon as stated above came to be remarkably seen as the base layer of the transfer sheet was made smaller. More specifically, too free motion of the coating layer surface may inevitably brings out not only the softness in the direction perpendicular to the surface, required for the effect of the present invention, but also a softness acting in the horizontal direction, so that the coating layer surface may cause a looper (measuring worm) motion and the dot toner image slips off to become scattered, as so presumed. It was certainly found that the transfer scatter was in such a shape that it looked elongated in the transfer sheet transport direction. Thus, the thickness of coated paper that depends on the base-layer thickness is also an important factor for bringing out the effect of the present invention well sufficiently.

EXAMPLE 4

Coated transfer sheets were produced using various materials, and the values of the "gradient H in the first region" which are the results of measurement with the above MH4000, manufactured by NEC, were determined to examine the correlation with transfer scatter.

Transfer Sheet A:

Art paper (McKinley Art 90).

Transfer Sheet B:

2 parts by weight of the material as used in Example 1, i.e., the resin having repeating units represented by the following Formulas (1) and (2) [containing 40 mole % of the component represented by the following Formula (2)] was dissolved in 78 parts by weight of n-hexane. Then, the resultant solution was put to a centrifugal separator to remove gel components, thus a coating material was produced. This coating material was coated on the above art paper by means of a Meyer bar (#16), followed by drying at 120° C. for 1 hour and further followed by drying at 140° C. for 1 hour to produce the transfer sheet of the present invention. After the drying, the resin coating layer was in a thickness of 2 μm.

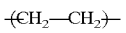

(1)

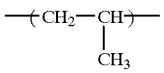

(2)

Transfer Sheet C:

2 parts by weight of a resin having repeating units represented by the following Formulas (3) and (4) [containing 5 mole % of the component represented by the following Formula (4)] was dissolved in 23 parts by weight of toluene. The resultant solution was coated on the above art paper by means of a Meyer bar (#8), followed by drying at 120° C. for 1 hour to produce a transfer sheet. After the drying, the resin coating layer was in a thickness of 2 μm.

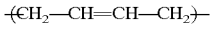

(3)

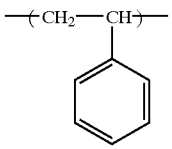

(4)

Transfer Sheet D:

Produced using the same type of material as used in the transfer sheet C but containing 45 mole % of the component represented by the above Formula (4).

Transfer Sheet E:

10 parts by weight of a thermoplastic polyurethane resin (trade name: ESTEN 5703; available from Kyowa Hakko Kogyo Co., Ltd.) was dissolved in 90 parts by weight of methyl ethyl ketone. Then, the resultant solution was subjected to pressure filtration with a filter of 1 μm in pore size, thus a coating material was prepared. This coating material was coated on the above art paper by means of a Meyer bar (#16), followed by drying at 120° C. for 1 hour to produce the transfer sheet of the present invention. After the drying, the resin coating layer was in a thickness of 3 μm.

Transfer Sheet F:

Commercially available recommended paper for full-color copying machines (Color Laser Copyer Paper 81.4 g, TKCLA4, available from Canon Sales Co., Inc.).

Transfer Sheet G:

Commercially available glossy paper for full-color copying machines (Color Laser Copyer Cardboard MS-701, available from Canon Sales Co., Inc.).

Transfer Sheet H:

Commercially available paper for full-color copying machines ("P-Photo Paper", available from Minolta Camera Co., Ltd.).

Results obtained are shown in Table 1. In Table 1, with regard to "Degree of transfer scatter", A, B, C and D four ranks are given to indicate the degree of transfer scatter.

TABLE 1

| Transfer sheet | First flexing point | Gradient H ($mN/\mu m^2$) | Degree of * transfer scatter |
|---|---|---|---|
| A | none | 0.25 | D |
| B | found | 0.0065 | A |
| C | found | 0.005 | A |
| D | none | 0.6 | D |
| E | found | 0.02 | B |
| F | none | 0.5 | D |
| G | none | 0.15 | D |
| H | none | 0.20 | D |

* A: Scatter little occurs.
B: Scatter is a little seen, but no problem.
C: Scatter is seen, providing poor quality.
D: Scatter is seen, providing very poor quality.

As can be seen from Table 1, the effect is less obtainable when the gradient H in the first flexing point is greater than the level of one decimal point the gradient H is 0.09 $mN/\mu m^2$ or smaller.

EXAMPLE 5

As conditions for producing the transfer sheets in the foregoing, art paper is used as base paper (the base layer), having a surface roughness Rz of 1 to 2 μm before coating. In the present Example, ordinary White Recycled Paper EW-500 (available from Canon Sales Co., Inc.) was used as paper for PPC (plain paper copier). A transfer sheet was produced using the same material and in the same manner as in Example 1 except that only the base paper was replaced. EW-500 had a surface roughness Rz of 10 to 20 μm before coating. As the result, when EW-500 was used as the base paper, the intended effect was partly obtainable, but any remarkable improvement was achievable.

The reason therefor was carefully examined to find that the roughness of the base paper before coating appeared exactly at the surface after coating. This has certainly good reason because the base paper having a thickness of 100 microns or larger is coated in a thickness of few microns. More specifically, the reason why the intended effect is not obtainable is that the contact between the photosensitive member and the transfer sheet surface at the time of transfer is in a nonuniform state at many spots. In order to better obtain the effect of the present invention, it may be necessary to use base paper having a small surface roughness to a certain degree. However, even when the base paper has a small roughness, it is clear that the transfer scattering can not be prevented even through the transfer sheet A in Example 4 has Rz of 1 to 2 μm. Thus, the surface roughness is not a necessary and sufficient condition.

EXAMPLE 6

Figure 8:
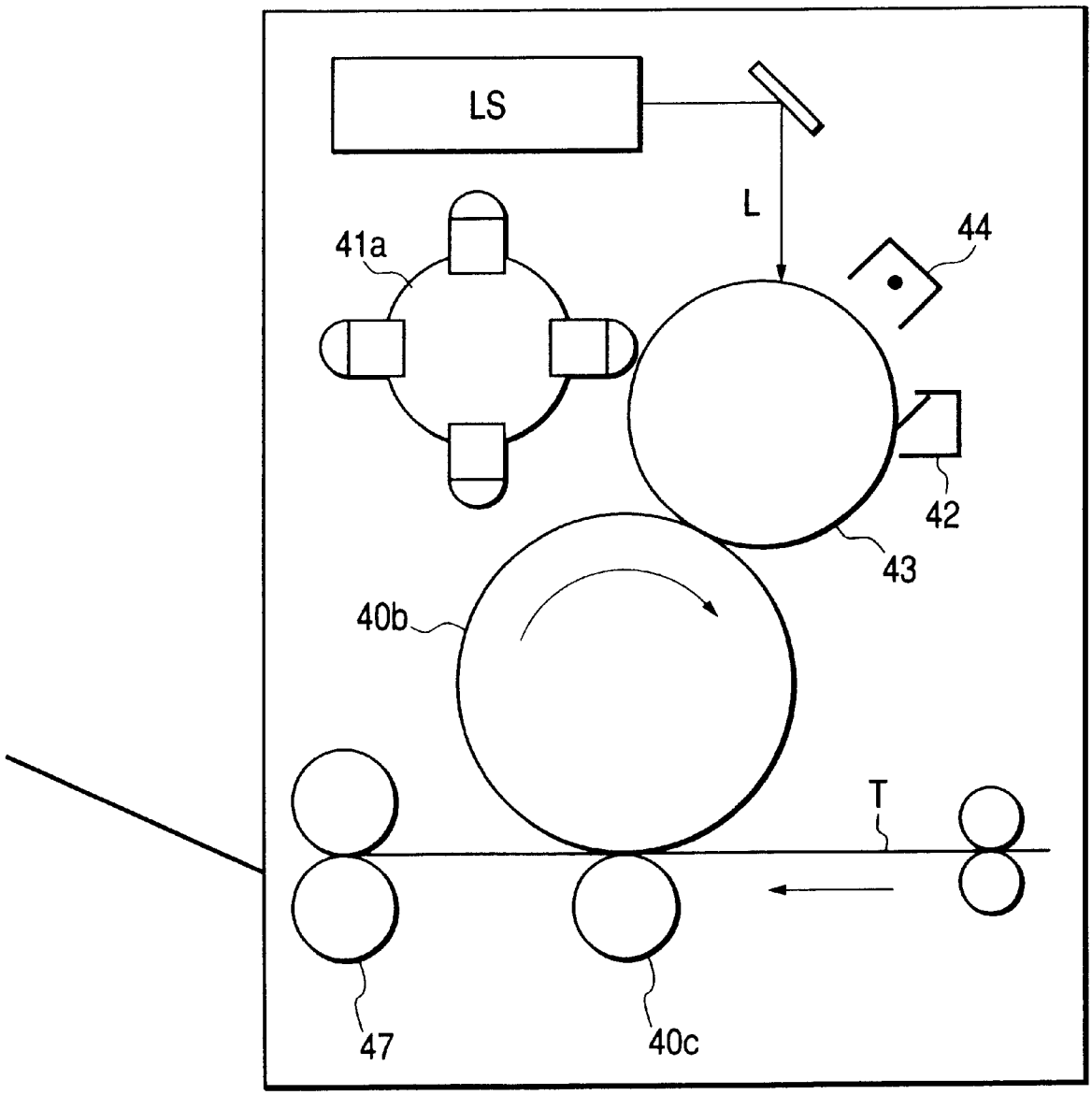
FIG. 8 is a diagrammatic view of a full-color printer used in Embodiment 6 of the present invention.

FIG. 8 illustrates a full-color printer used in Example 6 according to the present invention. In this full-color printer, a photosensitive drum 43 is exposed to laser light L from a laser exposure unit LS in accordance with image signals. The image signals may be fed from a computer, to which a scanner may be connected to set up a color copying machine.

The photosensitive drum 43 as an image-bearing member is uniformly charged to about −700 V by means of a corona charging assembly 44, and then exposed to the laser light L in accordance with image signals. Thus, an electrostatic latent image is formed on the photosensitive drum 43, and then developed by means of a developer, so that a toner image is formed.

A rotary developing unit 41*a* has four developing assemblies holding four color toners respectively, provided at intervals of 90 degrees in a circle. This rotary developing unit 41*a* is so rotated that the respective developing assemblies sequentially come to face the photosensitive drum 43 when images of corresponding colors are formed.

First, as a first color, a yellow toner image is formed by developing an electrostatic latent image by means of a yellow-toner-holding developing assembly in the rotary developing unit 41*a*.

An intermediate transfer member 40*b* is comprised of a metallic drum having a medium-resistance rubber layer on its surface, and a transfer bias is kept applied to this metallic drum.

The yellow toner image formed on the photosensitive drum 43 is transferred to the intermediate transfer member 40*b*. On the photosensitive drum 43, the next magenta toner image is formed, and is multiple-transferred onto the yellow toner image having been transferred onto the intermediate transfer member 40*b*. Such steps of image formation are repeated on cyan toner and black toner images, and these toner images are sequentially multiple-transferred onto the intermediate transfer member 40*b*.

After the four color toner images have primarily been multiple-transferred, the toner images held on the intermediate transfer member 40*b* are, while a transfer sheet T is brought into contact with the intermediate transfer member 40*b*, secondarily transferred to the transfer sheet by the aid of a bias voltage applied to a transfer roller 40*c* serving as a secondary transfer means, and then they are heat-fixed by means of a fixing assembly 47.

Transfer residual toner on the photosensitive drum 43 and that on the intermediate transfer member 40*b* are removed by means of a cleaner 42 brought into contact with them.

In such an intermediate transfer system involving a primary transfer step from the photosensitive member to the intermediate transfer member and a secondary transfer step from the intermediate transfer member to the transfer sheet as described above, what most causes the noise peculiar to electrophotography is at the time of transfer to the transfer sheet T, i.e., at use of exclusive paper as in the present invention enables reduction of the noise at the time of secondary transfer, and even only this can bring about a great improvement in image quality in the intermediate transfer system.

EXAMPLE 7

In the present example, Al (aluminum) foil was used as the base layer in place of base paper. A transfer sheet was produced using the same material and in the same manner as in Example 1 except that only the base paper was replaced. The aluminum foil had a surface roughness Rz of 0.01 to 0.1 $\mu$m before coating. As the result, also when aluminum foil was used as the base layer, the effect of the present invention was confirmed.

Using MH4000, manufactured by NEC, the tip of a diamond triangular pyramid penetrator having a dihedral angle of 80° was pressed in the transfer surface layer of the above transfer sheet at an indentation rate of 21 nm/s to draw a plot graph with load P (mN) as ordinate and the square of indentation depth A ($\mu$m) as abscissa, where the plot graph had a first flexing point that appears first, a first region extending from the first flexing point to zero and a second-and-further region subsequent to the first flexing point, and the gradient H of the graph in the first region was found to be 0.0067 mN/$\mu$m$^2$, and an average of the gradient of the graph in the second-and-further region subsequent to the first flexing point was found to be 0.14 mN/$\mu$m$^2$.

As in the foregoing examples, not only paper made from pulp but also metal foil such as aluminum foil may be used as the base layer of the transfer sheet. A resin sheet also may be used.

As described above, according to the present invention, a resin or an elastomer coating layer is provided at the transfer surface of a transfer sheet and the gradient H is made not greater than the stated value, whereby the toner image can be kept from scattering at the time of transfer to materialize formation of images with a higher image quality.

What is claimed is:

1. A transfer sheet for electrophotography comprising:

a base layer; and a surface layer formed on at least one surface of said base layer, wherein a plot graph with a load P (mN) as an ordinate and a square of indentation depth A ($\mu$m) as an abscissa, plotted when a tip of a diamond triangular pyramid penetrator having a dihedral angle of 80° is pressed in on a side of said surface layer, has a first gradient over a first region extending from a first flexing point to zero, and a second gradient over a second-and-further region subsequent to the first flexing point, wherein the first gradient is 0.09 mN/$\mu$m$^2$ or smaller, and wherein said base layer comprises paper made from pulp.

2. The transfer sheet according to claim 1, wherein the first gradient is smaller than the second gradient.

3. The transfer sheet according to claim 1, wherein said surface layer is formed of one of a resin and an elastomer.

4. The transfer sheet according to claim 1, wherein said surface layer has a layer thickness of 100 $\mu$m or smaller.

5. The transfer sheet according to claim 1, wherein said surface layer has a layer thickness in the range of 0.5 $\mu$m to 100 $\mu$m.

6. The transfer sheet according to claim 1, wherein said surface layer has a layer thickness in the range of 1 m to 100 $\mu$m.

7. The transfer sheet according to claim 1, wherein said surface layer has a surface roughness Rz of 10 $\mu$m or lower.

8. The transfer sheet according to claim 1, which is used in an electrophotographic apparatus, which performs a step of exposing a photosensitive member to light beams modulated in accordance with input signals, and on which an image is formed through a step of transferring a toner image onto the transfer sheet.

9. The transfer sheet according to claim 1, which is used in an electrophotographic apparatus for forming a full-color image or a multi-color image, and on which the full-color image or multi-color image is formed through a step of transferring color toner images onto the transfer sheet.

10. An electrophotography image-forming method comprising:

a toner image forming step of forming a toner image by means of a toner; and a transfer step of transferring the toner image to a transfer sheet for electrophotography, wherein the transfer sheet includes a base layer and a surface layer formed on at least one surface of the base layer, wherein a plot graph with a load P (mN) as an ordinate and a square of indentation depth A ($\mu$m) as an abscissa, plotted when a tip of a diamond triangular pyramid penetrator having a dihedral angle of 80° is pressed in on a side of the surface layer, has a first gradient over a first region extending from the first flexing point to zero and a second gradient over a second-and-further region subsequent to the first flexing point, wherein the first gradient is 0.09 mN/$\mu m^2$ or smaller, and wherein the base layer comprises paper made from pulp.

11. The method according to claim 10, wherein the first gradient is smaller than the second gradient.

12. The method according to claim 10, wherein the surface layer is formed of one of a resin and an elastomer.

13. The method according to claim 10, wherein the surface layer has a layer thickness of 100 $\mu$m or smaller.

14. The method according to claim 10, wherein the surface layer has a layer thickness in the range of 0.5 $\mu$m to 100 $\mu$m.

15. The method according to claim 10, wherein the surface layer has a layer thickness in the range of 1 $\mu$m to 100 $\mu$m.

16. The method according to claim 10, wherein the surface layer has a surface roughness Rz of 10 $\mu$m or lower.

17. The method according to claim 10, further comprising, prior to said toner image forming step, an exposing step of exposing a photosensitive member to light beams modulated in accordance with input signals.

18. The method according to claim 10, wherein said transfer step transfers color toner images onto the transfer sheet.

19. The method according to claim 10, wherein said toner image forming step comprises a charging step of charging an image-bearing member for holding thereon an electrostatic latent image; a latent-image-forming step of forming the electrostatic latent image on the image-bearing member thus charged; and a developing step of developing the electrostatic latent image held on the image-bearing member, with a toner to form a toner image, and wherein said transfer step comprises transferring to the transfer sheet the toner image formed on the image-bearing member.

20. The method according to claim 19, wherein in said latent-image-forming step the electrostatic latent image is formed on the image-bearing member by exposing the image-bearing member to light beams modulated in accordance with input signals.

21. The method according to claim 10, wherein said toner image forming step comprises a first toner-image-forming step of forming a first toner image by means of a first toner, and a first transfer step of transferring the first toner image to the transfer sheet, a second toner-image-forming step of forming a second toner image by means of a second toner, and wherein said transfer step comprises a first transfer step of transferring the first toner image to the transfer sheet; and a second transfer step of transferring the second toner image to the transfer sheet to which the first toner image has been transferred, whereby multiple-transferred images having the first toner image and second toner image are formed on the transfer sheet.

22. The method according to claim 10, wherein said toner image forming step comprises a first charging step of charging an image-bearing member for holding thereon an electrostatic latent image; a first latent-image-forming step of forming a first electrostatic latent image on the image-bearing member thus charged; a first developing step of developing the first electrostatic latent image held on the image-bearing member, with a first toner to form a first toner image; a first transfer step of transferring to the transfer sheet the first toner image formed on the image-bearing member; a second charging step of charging the image-bearing member for holding thereon an electrostatic latent image; a second latent-image-forming step of forming a second electrostatic latent image on the image-bearing member thus charged; and a second developing step of developing the second electrostatic latent image held on the image-bearing member, with a second toner to form a second toner image, and wherein said transfer step comprises a first transfer step of transferring to the transfer sheet the first toner image formed on the image-bearing member; and a second transfer step of transferring the second toner image formed on the image-bearing member, to the transfer sheet to which the first toner image has been transferred.

23. The method according to claim 22, wherein in said first latent-image-forming step the first electrostatic latent image is formed on the image-bearing member by exposing the image-bearing member to light beams modulated in accordance with input signals, and in said second latent-image-forming step the second electrostatic latent image is formed on the image-bearing member by exposing the image-bearing member to light beams modulated in accordance with input signals.

24. The method according to claim 10, wherein said toner image forming step comprises a first toner-image-forming step of forming a first toner image by means of a first toner, a first transfer step of transferring the first toner image to the transfer sheet, a second toner-image-forming step of forming a second toner image by means of a second toner, a third toner-image-forming step of forming a third toner image by means of a third toner; and a fourth toner-image-forming step of forming a fourth toner image by means of a fourth toner, and wherein said transfer step comprises a first transfer step of transferring the first toner image to the transfer sheet; a second transfer step of transferring the second toner image to the transfer sheet to which the first toner image has been transferred; a third transfer step of transferring the third toner image to the transfer sheet to which the first toner image and second toner image have been transferred; and a fourth transfer step of transferring the fourth toner image to the transfer sheet to which the first toner image, second toner image and third toner image have been transferred, whereby multiple-transferred images having the first toner image, second toner image, third toner image, and fourth toner image are formed on the transfer sheet, wherein the first toner, the second toner, the third toner, and the fourth toner each comprise any of a cyan toner, a magenta toner, a yellow toner, and a black toner, and wherein the multiple-transferred images include any of a cyan toner image, a magenta toner image, a yellow toner image, and a black toner image.

25. The method according to claim 10, wherein said toner image forming step comprises a first charging step of charging an image-bearing member for holding thereon an electrostatic latent image; a first latent-image-forming step of forming a first electrostatic latent image on the image-bearing member thus charged; a first developing step of developing the first electrostatic latent image held on the image-bearing member, with a first toner to form a first toner image; a first transfer step of transferring to the transfer sheet the first toner image formed on the image-bearing member;

a second charging step of charging the image-bearing member for holding thereon an electrostatic latent image; a second latent-image-forming step of forming a second electrostatic latent image on the image-bearing member thus charged; a second developing step of developing the second electrostatic latent image held on the image-bearing member, with a second toner to form a second toner image; a second transfer step of transferring the second toner image formed on the image-bearing member, to the transfer sheet to which the first toner image has been transferred; a third charging step of charging the image-bearing member for holding thereon an electrostatic latent image; a third latent-image-forming step of forming a third electrostatic latent image on the image-bearing member thus charged; a third developing step of developing the third electrostatic latent image held on the image-bearing member, with a third toner to form a third toner image; a third transfer step of transferring the third toner image formed on the image-bearing member, to the transfer sheet to which the first toner image and second toner image have been transferred; a fourth charging step of charging the image-bearing member for holding thereon an electrostatic latent image; a fourth latent-image-forming step of forming a fourth electrostatic latent image on the image-bearing member thus charged; and a fourth developing step of developing the fourth electrostatic latent image held on the image-bearing member, with a fourth toner to form a fourth toner image, and wherein said transfer step comprises a first transfer step of transferring to the transfer sheet the first toner image formed on the image-bearing member; a second transfer step of transferring the second toner image formed on the image-bearing member, to the transfer sheet to which the first toner image has been transferred; a third transfer step of transferring the third toner image formed on the image-bearing member, to the transfer sheet to which the first toner image and second toner image have been transferred; and a fourth transfer step of transferring the fourth toner image formed on the image-bearing member, to the transfer sheet to which the first toner image, second toner image, and third toner image have been transferred.

26. The method according to claim 27, wherein in said first latent-image-forming step the first electrostatic latent image is formed on the image-bearing member by exposing the image-bearing member to light beams modulated in accordance with input signals, in said second latent-image-forming step the second electrostatic latent image is formed on the image-bearing member by exposing the image-bearing member to light beams modulated in accordance with input signals, in said third latent-image-forming step the third electrostatic latent image is formed on the image-bearing member by exposing the image-bearing member to light beams modulated in accordance with input signals, and in said fourth latent-image-forming step the fourth electrostatic latent image is formed on the image-bearing member by exposing the image-bearing member to light beams modulated in accordance with input signals.

27. The method according to claim 10, wherein a first toner image is formed by means of a first toner and is primarily transferred onto an intermediate transfer member, a second toner image is formed by means of a second toner and is primarily transferred onto the intermediate transfer member to which the first toner image has been transferred, and the first toner image and second toner image having been primarily transferred onto the intermediate transfer member are then transferred onto the transfer sheet to form multiple-transferred images having the first toner image and second toner image.

28. The method according to claim 10, wherein said toner image forming step comprises a first charging step of charging an image-bearing member for holding thereon an electrostatic latent image; a first latent-image-forming step of forming a first electrostatic latent image on the image-bearing member thus charged; a first developing step of developing the first electrostatic latent image held on the image-bearing member, with a first toner to form a first toner image; a first transfer step of primarily transferring to an intermediate transfer member the first toner image formed on the image-bearing member; a second charging step of charging the image-bearing member for holding thereon an electrostatic latent image; a second latent-image-forming step of forming a second electrostatic latent image on the image-bearing member thus charged; and a second developing step of developing the second electrostatic latent image held on the image-bearing member, with a second toner to form a second toner image; and wherein said transfer step comprises a first transfer step of primarily transferring to an intermediate transfer member the first toner image formed on the image-bearing member; a second transfer step of primarily transferring the second toner image formed on the image-bearing member, to the intermediate transfer member to which the first toner image has been transferred; and a secondary transfer step of transferring to the transfer sheet the first toner image and second toner image having been primarily transferred to the intermediate transfer member.

29. The method according to claim 28, wherein in said first latent-image-forming step the first electrostatic latent image is formed on the image-bearing member by exposing the image-bearing member to light beams modulated in accordance with input signals, and in said second latent-image-forming step the second electrostatic latent image is formed on the image-bearing member by exposing the image-bearing member to light beams modulated in accordance with input signals.

30. The method according to claim 10, wherein a first toner image is formed by means of a first toner and is primarily transferred onto an intermediate transfer member, a second toner image is formed by means of a second toner and is primarily transferred onto the intermediate transfer member to which the first toner image has been transferred, a third toner image is formed by means of a third toner and is primarily transferred onto the intermediate transfer member to which the first toner image and second toner image have been transferred, a fourth toner image is formed by means of a fourth toner and is primarily transferred onto the intermediate transfer member to which the first toner image, second toner image, and third toner image have been transferred, wherein the first toner image, second toner image, third toner image, and fourth toner image have been primarily transferred onto the intermediate transfer member are then transferred onto the transfer sheet to form multiple-transferred images having the first toner image, second toner image, third toner image, and fourth toner image, wherein the first toner, the second toner, the third toner, and the fourth toner each comprise any of a cyan toner, a magenta toner, a yellow toner, and a black toner, and wherein the multiple-transferred images include any of a cyan toner image, a magenta toner image, a yellow toner image, and a black toner image.

31. The method according to claim 10, wherein said toner image forming step comprises a first charging step of charging an image-bearing member for holding thereon an electrostatic latent image; a first latent-image-forming step of forming a first electrostatic latent image on the image-bearing member thus charged; a first developing step of developing the first electrostatic latent image held on the image-bearing member, with a first toner to form a first toner image; a first transfer step of primarily transferring to an intermediate transfer member the first toner image formed on the image-bearing member; a second charging step of charging the image-bearing member for holding thereon an electrostatic latent image; a second latent-image-forming step of forming a second electrostatic latent image on the image-bearing member thus charged; a second developing step of developing the second electrostatic latent image held on the image-bearing member, with a second toner to form a second toner image; a second transfer step of primarily transferring the second toner image formed on the image-bearing member, to the intermediate transfer member to which the first toner image has been transferred; a third charging step of charging the image-bearing member for holding thereon an electrostatic latent image; a third latent-image-forming step of forming a third electrostatic latent image on the image-bearing member thus charged; a third developing step of developing the third electrostatic latent image held on the image-bearing member, with a third toner to form a third toner image; a third transfer step of primarily transferring the third toner image formed on the image-bearing member, to the intermediate transfer member to which the first toner image and second toner image have been transferred; a fourth charging step of charging the image-bearing member for holding thereon an electrostatic latent image; a fourth latent-image-forming step of forming a fourth electrostatic latent image on the image-bearing member thus charged; and a fourth developing step of developing the fourth electrostatic latent image held on the image-bearing member, with a fourth toner to form a fourth toner image, wherein said transfer step comprises a first transfer step of primarily transferring to an intermediate transfer member the first toner image formed on the image-bearing member; a second transfer step of primarily transferring the second toner image formed on the image-bearing member, to the intermediate transfer member to which the first toner image has been transferred; a third transfer step of primarily transferring the third toner image formed on the image-bearing member, to the intermediate transfer member to which the first toner image and second toner image have been transferred; a fourth transfer step of primarily transferring the fourth toner image formed on the image-bearing member, to the intermediate transfer member to which the first toner image, second toner images and third toner image have been transferred; and a secondary transfer step of transferring to the transfer sheet the first toner image, second toner image, third toner image, and fourth toner image having been primarily transferred to the intermediate transfer member.

32. The method according to claim 31, wherein in said first latent-image-forming step the first electrostatic latent image is formed on the image-bearing member by exposing the image-bearing member to light beams modulated in accordance with input signals, in said second latent-image-forming step the second electrostatic latent image is formed on the image-bearing member by exposing the image-bearing member to light beams modulated in accordance with input signals, in the third latent-image-forming step the third electrostatic latent image is formed on the image-bearing member by exposing the image-bearing member to light beams modulated in accordance with input signals, and in the fourth latent-image-forming step the fourth electrostatic latent image is formed on the image-bearing member by exposing the image-bearing member to light beams modulated in accordance with input signals.

* * * * *

UNITED STATES PATENT AND TRADEMARK OFFICE

CERTIFICATE OF CORRECTION

PATENT NO. : 6,558,861 B2
DATED : May 6, 2003
INVENTOR(S) : Nobuyuki Ito et al.

It is certified that error appears in the above-identified patent and that said Letters Patent is hereby corrected as shown below:

Column 2,
Line 45, "Examples" should read -- examples --.

Column 3,
Line 38, "smaller." should read -- smaller; --.

Column 6,
Line 40, "multi-level" should read -- multilevel --.

Column 12,
Line 42, "brings" should read -- bring --.

Column 14,
Line 47, "can not" should read -- cannot --.

Column 16,
Line 39, "1m" should read -- 1 μm --; and
Line 56, "image forming" should read -- image-forming --.

Column 19,
Line 41, "27" should read -- 25 --.

Column 22,
Line 15, "images" should read -- image --.

Signed and Sealed this

Eleventh Day of November, 2003

JAMES E. ROGAN
*Director of the United States Patent and Trademark Office*